US007597670B2

(12) United States Patent
Warwick et al.

(10) Patent No.: US 7,597,670 B2
(45) Date of Patent: *Oct. 6, 2009

(54) CHEST COMPRESSION APPARATUS

(76) Inventors: Warren J. Warwick, 1952 E. River Ter., Minneapolis, MN (US) 55414; Leland G. Hansen, 2309 Beverly Rd., St. Paul, MN (US) 55104

( * ) Notice: Subject to any disclaimer, the term of this patent is extended or adjusted under 35 U.S.C. 154(b) by 850 days.

This patent is subject to a terminal disclaimer.

(21) Appl. No.: 11/204,547

(22) Filed: Aug. 15, 2005

(65) Prior Publication Data

US 2006/0036199 A1 Feb. 16, 2006

Related U.S. Application Data

(63) Continuation-in-part of application No. 10/038,208, filed as application No. PCT/US00/18037 on Jun. 29, 2000, now Pat. No. 6,958,046.

(60) Provisional application No. 60/142,112, filed on Jul. 2, 1999.

(51) Int. Cl.

| | |
|---|---|
| ***A61H 31/00*** | (2006.01) |
| ***A61H 31/02*** | (2006.01) |
| ***A61H 7/00*** | (2006.01) |
| ***A61H 19/00*** | (2006.01) |

(52) U.S. Cl. ..... 601/152; 601/44; 601/151

(58) Field of Classification Search ..... 601/41–44, 601/148–152; 602/12; 606/202; 128/205.24
See application file for complete search history.

(56) References Cited

U.S. PATENT DOCUMENTS

| | | | | |
|---|---|---|---|---|
| 2,588,192 | A * | 3/1952 | Akerman et al. | 601/44 |
| 3,462,778 | A | 8/1969 | Whitney | |
| 4,135,500 | A * | 1/1979 | Gorran | 601/150 |
| 4,197,837 | A | 4/1980 | Tringali et al. | |
| 4,311,135 | A * | 1/1982 | Brueckner et al. | 601/152 |
| 4,838,263 | A | 6/1989 | Warwick et al. | |
| 4,977,889 | A | 12/1990 | Budd | |
| 5,056,505 | A * | 10/1991 | Warwick et al. | 601/44 |
| 5,453,081 | A | 9/1995 | Hansen | |

(Continued)

FOREIGN PATENT DOCUMENTS

| | | |
|---|---|---|
| WO | WO 95/32753 | 12/1995 |

OTHER PUBLICATIONS

Milla, Carlos E. et al., "High-Frequency Chest Compression: Effect of the Third Generation Compression Waveform," Instrument Research, Jul./Aug. 2004, pp. 322-328.

*Primary Examiner*—Justine R Yu
*Assistant Examiner*—Kristen C Matter
(74) *Attorney, Agent, or Firm*—Briggs and Morgan, P.A.

(57) ABSTRACT

A chest compression apparatus for use by patients with cystic fibrosis, the preferred apparatus including an air flow generator component, a pulse frequency control component having a fan blade valve for producing a sinusoidal wave form, an optional pressure control component, and a patient vest. The apparatus can be used to apply sharp compression pulses to the entire thorax via the inflatable vest worn by the patient. The optional modular nature of the present apparatus provides particular benefits in the manufacture and use of the present apparatus. The modular nature, in essence, provides even greater portability since one or more modules can be individually replaced or repaired as needed, thereby lessening the overall cost and inconvenience to the patient.

43 Claims, 8 Drawing Sheets

U.S. PATENT DOCUMENTS

| | | | | |
|---|---|---|---|---|
| 5,490,820 | A | 2/1996 | Schock et al. | |
| 5,569,170 | A | 10/1996 | Hansen | |
| 5,769,797 | A | 6/1998 | Van Brunt et al. | |
| 5,769,800 | A | 6/1998 | Gelfand et al. | |
| 5,997,488 | A | 12/1999 | Gelfand et al. | |
| 6,030,353 | A | 2/2000 | Van Brunt | |
| 6,036,662 | A | 3/2000 | Van Brunt et al. | |
| 6,155,996 | A | 12/2000 | Van Brunt et al. | |
| 6,179,796 | B1 * | 1/2001 | Waldridge | 601/149 |
| 6,182,658 | B1 | 2/2001 | Hayek | |
| 6,210,345 | B1 | 4/2001 | Van Brunt | |
| 6,254,556 | B1 | 7/2001 | Hansen et al. | |
| 6,340,025 | B1 | 1/2002 | Van Brunt | |
| D453,560 | S | 2/2002 | Van Brunt | |
| 6,379,316 | B1 | 4/2002 | Van Brunt et al. | |
| D456,591 | S | 5/2002 | Hansen | |
| 6,415,791 | B1 | 7/2002 | Van Brunt | |
| D461,897 | S | 8/2002 | Hansen et al. | |
| 6,471,663 | B1 | 10/2002 | Van Brunt et al. | |
| 6,488,641 | B2 | 12/2002 | Hansen | |
| D469,876 | S | 2/2003 | Hansen et al. | |
| 6,547,749 | B2 | 4/2003 | Hansen | |
| D478,989 | S | 8/2003 | Hansen et al. | |
| 6,605,050 | B2 | 8/2003 | Hansen | |
| 6,676,614 | B1 | 1/2004 | Hansen et al. | |
| 6,736,785 | B1 | 5/2004 | Van Brunt | |
| 6,757,916 | B2 | 7/2004 | Mah et al. | |
| 6,764,455 | B2 | 7/2004 | Van Brunt et al. | |
| 6,910,479 | B1 | 6/2005 | Van Brunt | |
| 6,916,298 | B2 | 7/2005 | VanBrunt et al. | |
| 6,958,046 | B2 | 10/2005 | Warwick et al. | |
| 2002/0014235 | A1 | 2/2002 | Rogers et al. | |
| 2006/0009718 | A1 | 1/2006 | Van Brunt et al. | |

* cited by examiner

CHEST COMPRESSION APPARATUS

CROSS REFERENCE TO RELATED APPLICATIONS

The present application is a continuation-in-part of U.S. Ser. No. 10/038,208, filed on Jan. 2, 2002 now U.S. Pat. No. 6,958,046, which claims priority to International Application No. PCT/US00/18037 filed on Jun. 29, 2000 (published as International Publication No. WO 01/01918), which in turn claims priority from provisional application having U.S. Ser. No. 60/142,112, filed Jul. 2, 1999 the entire disclosures of which are incorporated herein by reference.

TECHNICAL FIELD

The present invention relates to oscillatory chest compression apparatuses, and in particular, those used for clearing mucous from the lungs, as in patients with cystic fibrosis.

BACKGROUND OF THE INVENTION

Cystic fibrosis is a deadly hereditary disease. With one in 20 people carrying the recessive gene, conception of a child having cystic fibrosis results in approximately one in every 400 child-bearing marriages. No cure for the disease has yet been discovered. Cystic fibrosis affects the mucus secreting glands of the body, leading to an overproduction of mucus. The lungs are continuously filled with the excess mucus, which in turn must be removed daily to reduce the build-up and the risk of infection. Presently, treatment generally involves an aerosol therapy three or four times a day to obtain bronchial drainage and a daily physical pounding on the chest wall to loosen mucus for expectoration. Daily treatment can range from four to six hours plus and necessitates a respirator therapist or at least a trained individual to provide the pummeling of the chest.

The art in the area of mechanical vibrations to the body shows such things as inflatable jackets or garments to put on a person to aid in respiration, such as artificial respiration. U.S. Pat. Nos. 3,043,292, 2,354,397, 2,588,192 are representative. Additionally, a garment which provides oscillations for the purpose of massaging the body is shown in U.S. Pat. No. 3,310,050.

In more recent years, a variety of high frequency chest compression ("HFCC") systems have been developed to aid in the clearance of mucus from the lung. Such systems typically involve the use of an air delivery device, in combination with a vest to be worn by a patient, with the two being connected by a valve or other device that permits the pulsed flow of air to the vest. Such vests were developed for patients with cystic fibrosis, and are designed to provide airway clearance therapy. The patient wears an inflatable vest that is linked to an air pulse generator that rapidly inflates and deflates the vest during inspiration and/or expiration. The compression pulses produce transient cephalad air flow bias spikes in the airways, which moves mucous toward the larger airways where it can be cleared by coughing. The prior vest systems differ from each other, in at least one respect, by the valves they employ (if any), and in turn, by such features as their overall weight and the wave form of the air produced.

Related patents describe systems having a variety of attributes, e.g., those in which an air stream is interrupted, as by the use of a regenerative blower with a rotary interrupt valve. Such systems are typified by a "quick dump", high volume rotary valve (also known as a "tube valve" or "chopper valve"). These types of valves typically produced a pulse form that most closely approximated near square wave pulses at about 10 to 20 Hz (i.e., not true sine waves), but which are said to become more sinusoidal as the frequency is decreased to 5 Hz.

U.S. Pat. No. 4,838,263 (Warwick et al.) describes an apparatus in which the application of pressurized pulses and the pulse rate are each controllable by the patient. The device addresses the desire of some patients to have the device provide less of a "thump" during inhalation. The device, in turn, permits the user to controllably cut the thumping pressure. In operation, the tank delivers air into the bladder, and the patient uses either a pedal to deliver more air and/or a thumb positioned over a tube, in order to release pressure.

U.S. Pat. No. 5,056,505 for a "Chest compression apparatus", invented by Warwick and Hansen relates to an oscillatory chest compression apparatus to aid in loosening and eliminating mucus from the lungs of a cystic fibrosis patient. The '505 patent describes an apparatus, including a valve that can be used to deliver a sharply spiked air pulse, such that the slope (rise time) of the pulse is defined as being at least twice as fast as that of a sinusoidal wave of the same frequency and amplitude. The valve itself involves the use of leading and following edges that serve to abruptly start and stop the flow of air. During inspiration, the atmospheric phase, the positive pressure side of the system can be blocked. The pressure pulse wave form is a function of the shape and size of the rotary valve ports and the pressure applied to the valve. The quick dump design of the valve ports allows for maximum opening in a short time. A constant pressure air stream is chopped into pulses and directed to the inflated vest.

Hansen U.S. Pat. No. 5,569,170 (assigned to Electromed, Inc. Minnetonka, Minn.) is directed to yet another alternative in which a speaker-like diaphragm is employed to deliver the pulses in the form of repetitive pressure pulses, much along the lines of a pulsating speaker.

U.S. Pat. No. 4,977,889 (Budd), in turn, describes an algorithm for use in tuning such an apparatus to a particular patient. The algorithm can be used to improve the effectiveness (mucous generation and air flow spikes) of any chest compression apparatus. Presently, doctors having such software can use the algorithm to set any particular device for a particular patient.

Finally, Van Brunt et al. (U.S. Pat. No. 5,769,797, "Oscillatory chest compression device") describes a compression device that includes an oscillatory air flow generator and a positive air flow generator. A first feedback system controls the oscillation rate of the oscillatory air flow generator, and a second feedback system controls the peak pressure created by the positive air flow generator.

Certain of the approaches described above have been embodied in various prototypes and/or commercial devices that have been previously developed. Applicant's own initial "Model 101", and later "Model 102" were developed and used previously, both employing a rotary ("chopper") valve, of the type described in the above-captioned '505 patent. These devices provided wave forms having a near square wave pulse form.

Currently, American Biosystems, Inc. markets a device ("Model 103") under the tradename "ThAIRapy Vest", as a device designed for self-administration of chest physical therapy for patients with cystic fibrosis and other chronic lung disorders. The vest is said to be a portable device that uses a technology called high frequency chest wall oscillation to provide airway clearance therapy. The vest includes an inflatable vest linked to an air pulse generator that inflates and deflates the vest from 5 to 25 times per second. This creates a high expiratory flow within the lungs which moves mucous toward the larger airways where it can be cleared by coughing. The device appears to include the use of a diaphragm driven by an electromagnet, which appears to provide a sine wave pulse form.

The units presently in commercial use, however, continue to be quite expensive, as well as large and heavy, and hence are not considered particularly portable. The community of patients suffering from these disease therefore continues to seek affordable devices that can provide comparable or improved features and performance, in a manner that provides improved portability.

SUMMARY OF THE INVENTION

Figure 1:
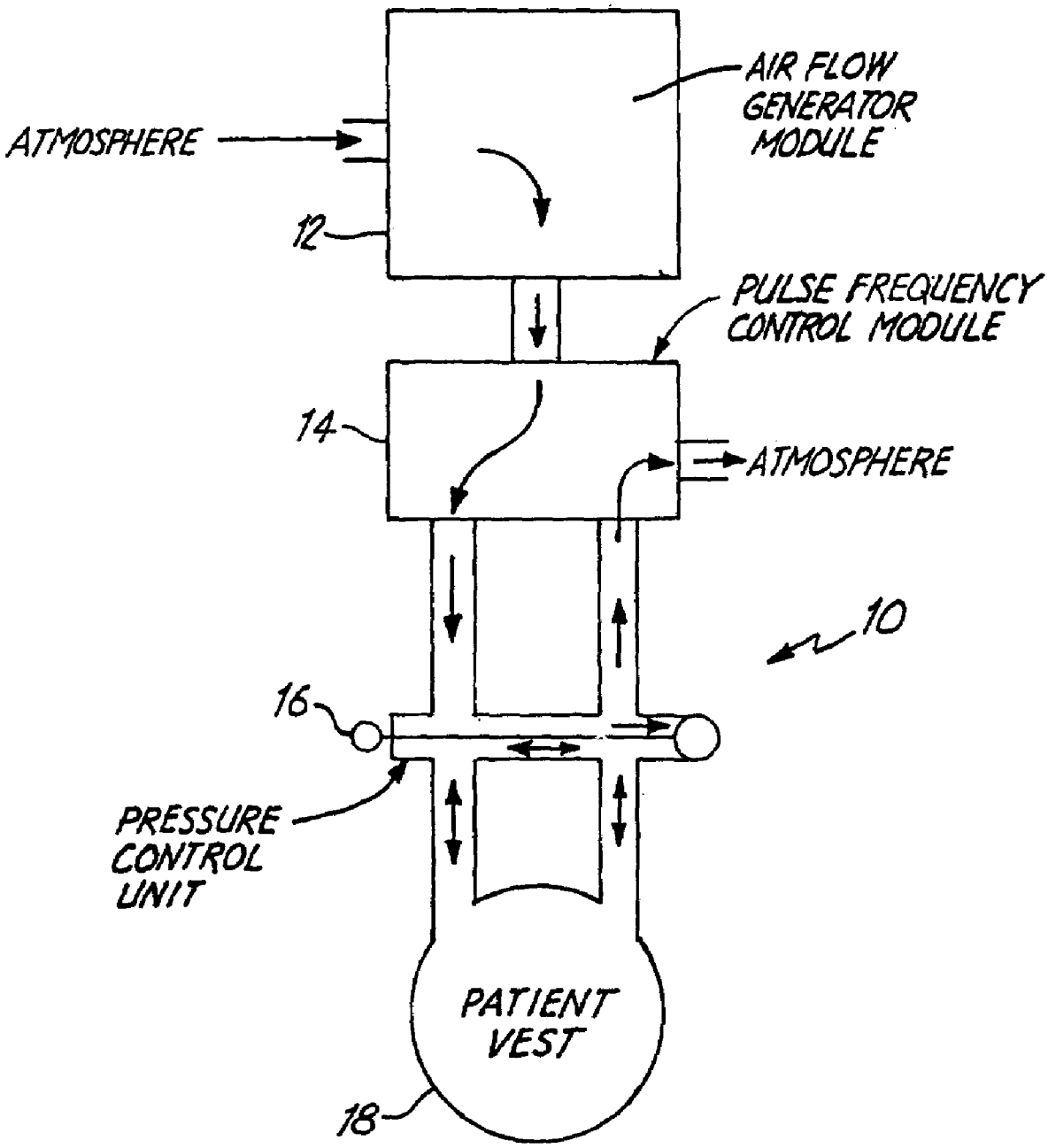
FIG. 1 shows a schematic air flow diagram for an apparatus of this invention.

The present invention is directed to a chest compression apparatus for the thoracic region of a patient. The apparatus includes a mechanism for applying a force to the thoracic region of the patient. The force applying mechanism includes a bladder for receiving pressurized air. The apparatus further includes a mechanism for supplying pressure pulses of pressurized air to the bladder. For example, the pulses may have a sinusoidal, triangular, square wave form, etc. The present apparatus, and in turn, the pulse form it delivers, provide several advantages over previous apparatuses, e.g., those of the '505 patent described above. Additionally, the apparatus optionally includes a mechanism for venting the pressurized air from the bladder. In addition to performance that is comparable to, if not better than, that provided by prior devices, the apparatus of the present invention can be manufactured and sold for considerably less than current devices, and can be provided in a form that is far more modular and portable than existing devices.

In a preferred embodiment, the apparatus comprises a plurality of components, including an air flow generator component, a pulse frequency control component, a pressure control component, and a patient vest, wherein the pulse frequency control and pressure control components can, independently, be used by the patient and/or can be preset and determined by the manufacturer or physician so as to deliver compression pulses, for example having a substantially sinusoidal wave form.

In a particularly preferred embodiment, the invention provides a chest compression apparatus comprising:

a) an air flow generator component adapted to provide a continuous stream of pressurized air, b) a pulse frequency control component in flowable communication with the air flow generator and comprising a fan valve adapted to periodically interrupt the air stream in order to provide pulses having, for example, a substantially sinusoidal wave form, c) optionally, a pressure control component in flowable communication with the pulse frequency control component and adapted to permit a user to control the pressure of the pulses, and d) a patient vest adapted to be worn by a user in order to receive the pulses in the form of corresponding force applied to the thoracic region.

The components of such an apparatus can be provided in the form of a plurality of portable modules having a combined weight of about 20 pounds or less, preferably about 15 pounds or less, and the apparatus provides a maximum pressure of about 60 mm Hg or less.

An apparatus of this invention can be used to apply sharp compression pulses to the entire thorax via an inflatable vest worn by the patient. The compression pulses produce transient cephalad airflow bias spikes in the airways. The airflows in the lungs are similar to those occurring in a huffing maneuver with its associated mucous shear flow. These higher airflow spikes produce the more desirable shear forces necessary for effective mucous clearance.

In a preferred embodiment of the present invention, a fan valve is used to establish and determine the rate and duration of air pulses entering the bladder from the pressure side and allows air to evacuate the bladder on the depressurizing side. An air generator (e.g., blower) is used on the pressurizing side of the fan valve. The fan valve advantageously provides a controlled communication between the blower and the bladder. Although not necessary, a preferred embodiment may also includes a pressure control switch. The control switch can be operated to decrease or stop pressurization during the inspiration portion of the patient's breathing cycle, depending on the desire of the patient.

The present apparatus provides a variety of solutions and options to the treatment problem faced by people having cystic fibrosis. The advantages of the invention relate to benefits derived from a treatment program using the present apparatus rather than a conventional device having a rotary valve and corresponding pulses. In this regard, a treatment program with the present apparatus provides a cystic fibrosis patient with independence in that the person can manipulate, move, and operate the machine alone. He/she is no longer required to schedule treatment with a trained individual. This results in increased psychological and physical freedom and self esteem. The person becomes flexible in his/her treatment and can add extra treatments, if desired, for instance in order to fight a common cold. An additional benefit is the corresponding decrease in cost of treatment, as well as a significant lessening of the weight (and in turn, increased portability) of the device itself.

The optional modular nature of the present apparatus provides particular benefits in the manufacture and use of the present apparatus. The modular nature, in essence, provides even greater portability since one or more modules can be individually replaced or repaired as needed, thereby lessening the overall cost and inconvenience to the patient. Moreover, the patient can keep duplicate or different versions of one or more modules at different locations, e.g., at work and at home, meaning that he or she need only transport the remaining modules in order to use the apparatus.

DETAILED DESCRIPTION

With reference to the Drawing, FIG. 1 shows a prototypical air flow diagram associated with an apparatus 10 of this invention. The apparatus includes an air flow generator component 12, flowably connected to a pulse frequency control module 14, which in turn is flowably connected to a pressure control unit 16, and finally to a vest 18 worn by the patient. The patient may be a human or other animal. For example, both human and equine applications may be practicable, with differently sized vests 18 being defined by the particular applications. In use, the air flow generator (e.g., motor driven blower) delivers pressurized air to the vest, via a pulse frequency control unit that preferably includes one or more rotating (e.g., fan-like) blades.

Figure 2:
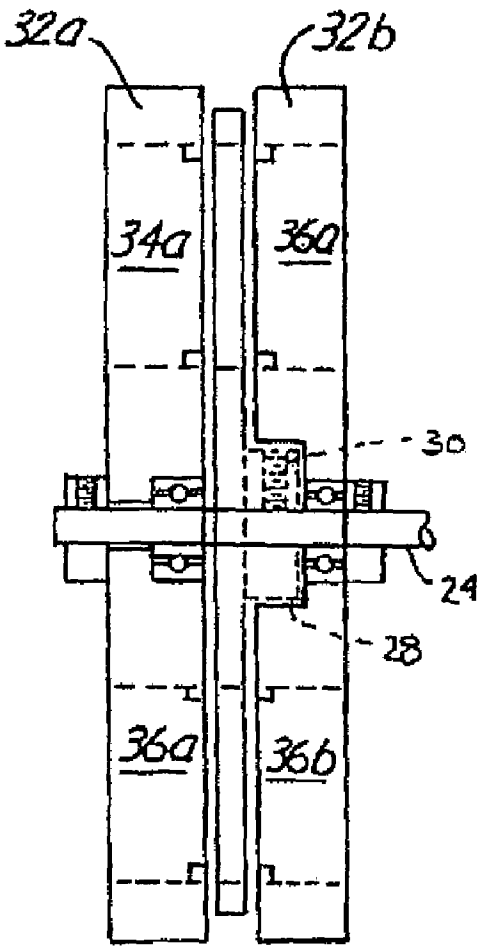
FIG. 2 shows a prototypical fan valve for use in an apparatus of this invention.
Figure 2:
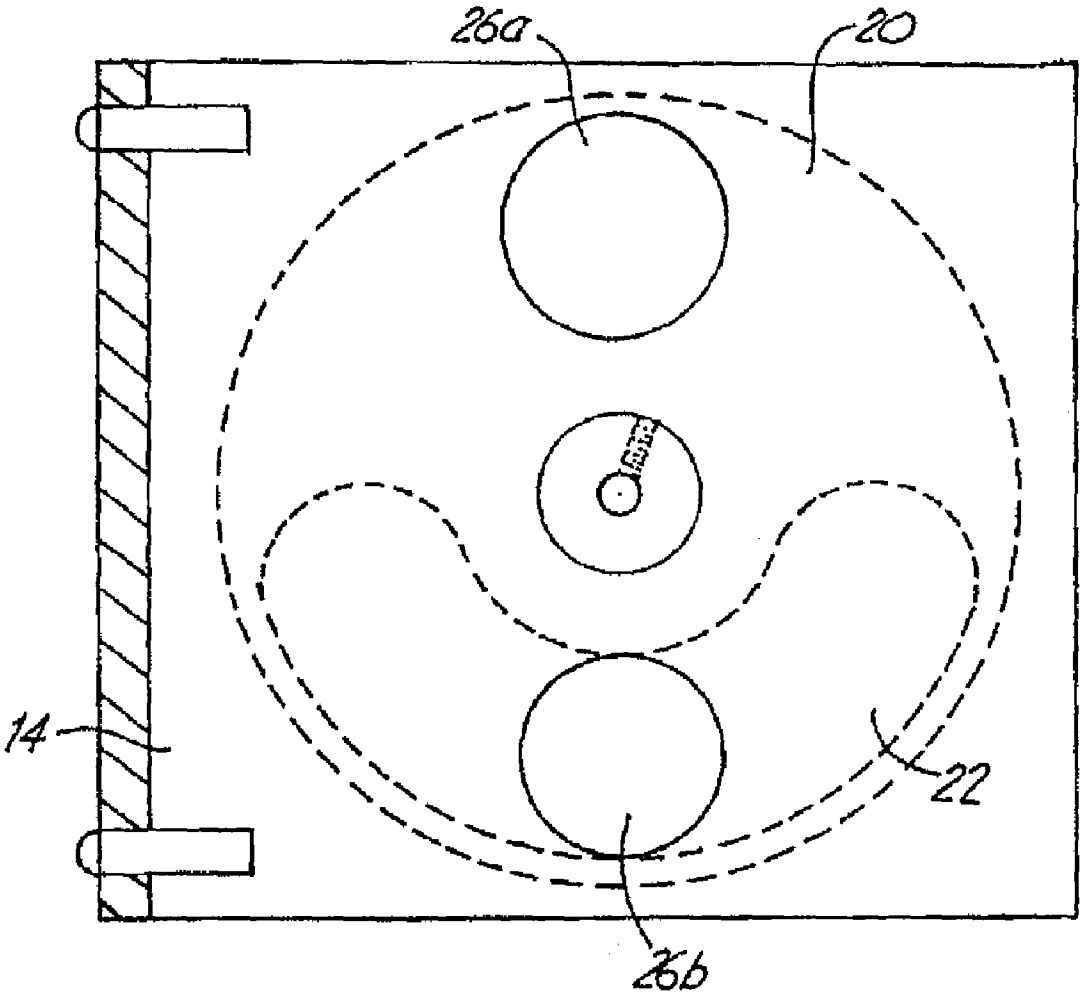

Such a blade is shown in FIG. 2, wherein the unit 14 is shown in cross section (2*a*) and on end (2*b*). The prototype shown includes a generally circular valve blade assembly 20, rotatable upon a central axis and having one or more cutout portions 22. The blade is retained on a centrally located motor driven shaft 24, which serves to rotate the blade, and in turn, provide airflow access to and through the cutout portion(s) in front the end plates of air ports 26*a* and 26*b*, respectively. Optionally, and as shown, the blade is connected to the drive shaft by means of a blade support collar 28 and set screw 30.

In a prototypical embodiment, the apparatus is provided in the form of a compact air pulse delivery apparatus that is considerably smaller than those presently or previously on the market (e.g., on the order of one-fifth to one-tenth the size and weight of the original Model 101), with no single modular component of the present apparatus weighing more than about 10 pounds. Hence the total weight of the present apparatus can be on the order of 20 pounds or less, and preferably on the order of 15 pound or less, making it considerably lighter and more portable than devices presently on the market. In an initial prototype, the air flow generator module 12 is provided in the form of a conventional motor and fan assembly, and is enclosed in a compartment having air inlet and outlet ports. The air inlet port can be open to atmosphere, while the outlet port can be flowably coupled to the pulse frequency module. In another embodiment, the air flow generator module 12 may include a variable speed air fan adapted to be used with an electronic motor speed controller. In such an embodiment, the amplitude of pulses transmitted to the air vest 18 may be controlled by adjusting the fan motor speed. In embodiments of the present invention, the amplitude of the pulses may be increased or decreased in response to received physiological signals providing patient information, such as inhalation and exhalation periods, etc.

In spite of its compact and optionally modular nature and relatively low weight, the apparatus of the present invention can provide pressurized pulses of on the order of 60 mm Hg or less, as compared to the current version of the aforementioned Model 103, which appears to limited to pulses of on the order of 40 mm Hg or less. The ability to provide pulses having higher pressure, while also minimizing the overall size and weight of the unit, is a particular advantage of the present apparatus as well. Pulses of over about 60 mm Hg are generally not desirable, since they can tend to lead to bruising.

As shown in corresponding FIG. 2*b*, a pair of end plates 32*a* and 32*b* are mounted on an axis concentric with that of motor drive shaft 24, and effectively sandwich the blade assembly between them. The end plates are provided with corresponding air ports 34*a* and 36*a* (in plate 32*a*) and 34*b* and 36*b* (in plate 32*b*). The air ports are overlapping such that air delivered from the external surface of either end plate will be free to exit the corresponding air port in the opposite plate, at such times as the blade cutout portion of the valve blade is itself in an overlapping position therebetween. By virtue of the rotation of cutout portions past the overlapping air ports, in the course of constant air delivery from one air port toward the other, the rotating fan blade effectively functions as a valve to permit air to pass into the corresponding air port in a semi-continuous and controllable fashion. The resultant delivery may take a sinusoidal wave form, by virtue of the shape and arrangement of the fan blade cutout portions.

Figure 3:
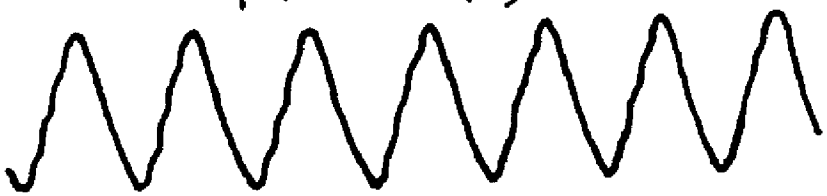
FIG. 3 shows a comparative plot of a wave form (a) provided by a rotating blade of this invention as compared to a wave form (b) provided by a reciprocating diaphragm of the type described above.
Figure 3:
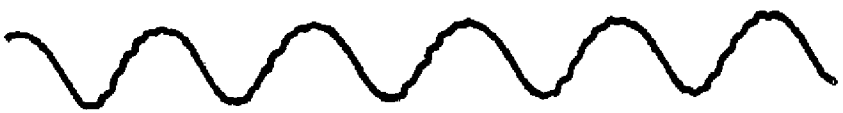

The pulse frequency module 14, in a preferred embodiment, is provided in the form of a motor-driven rotating blade ("fan valve") adapted to periodically interrupt the air stream from the air flow generatro 12. During these brief interruptions air pressure builds up behind the blade. When released, as by the passage of the blade, the air travels as a pressure pulse to the vest worn by the patient. The resulting pulses can be in the form of fast rise, sine wave pressure pulses. These pulses, in turn, can produce significantly faster air movement in the lungs, in the therapeutic frequency range of about 6 Hz to about 15 Hz, as measured at the mouth. These can be compared to the sinusoidal wave pulses such as those produced by the reciprocating diaphragm (FIG. 3*b*). In combination with higher flow rates into the lungs, as achieved using the present apparatus, these factors result in stronger mucus shear action, and thus more effective therapy in a shorter period of time.

Those skilled in the art will understand the manner in which a fan valve of the present invention can be adapted (e.g., by configuring the dimensions, pitch, etc. of one or more fan blades) to provide wave pulses in a variety of forms, including sine waves, near sine waves (e.g., waves having precipitous rising and/or falling portions, as provided by the rotary valve of the above-described '505 patent), and complex waves. As used herein a sine wave can be generally defined as any uniform wave that is generated by a single frequency, and in particular, a wave whose amplitude is the sine of a linear function of time when plotted on a graph that plots amplitude against time. The pulses can also include one or more relatively minor perturbations or fluctuations within and/or between individual waves, such that the overall wave form is substantially as described above. Such perturbations can be desirable, for instance, in order to provide more efficacious mucus production in a manner similar to traditional hand delivered chest massages. Moreover, the pulse frequency module 14 of the present invention can be programmed and controlled electronically to allow for the automatic timed cycling of frequencies, with the option of manual override at any frequency.

Figure 4:
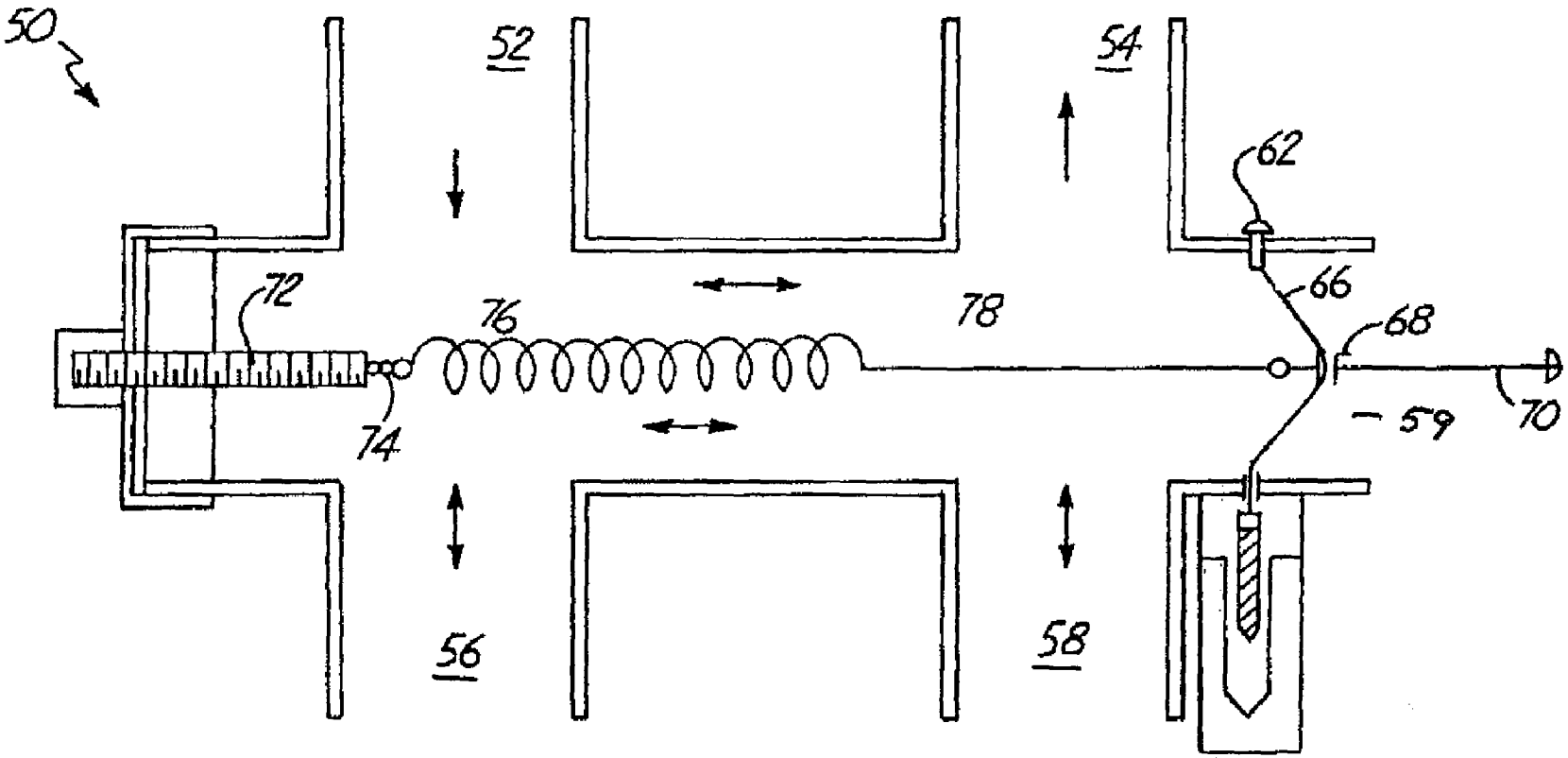
FIG. 4 shows a diagrammatic representation of a suitable pressure control unit for use in an apparatus of the present invention.
Figure 5A:
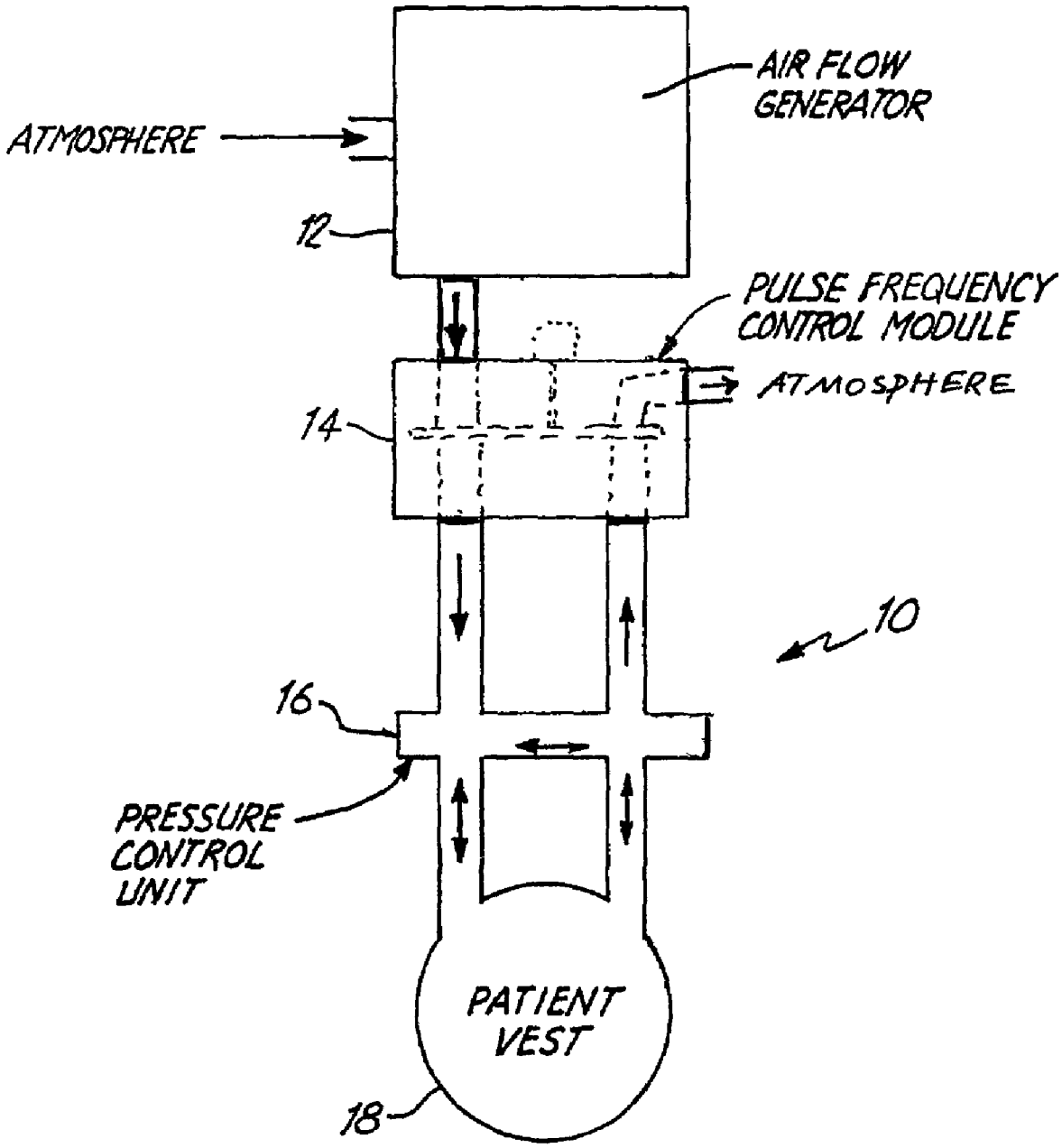
FIG. 5 shows schematic air flow diagrams for apparatuses of the present invention.
Figure 5B:
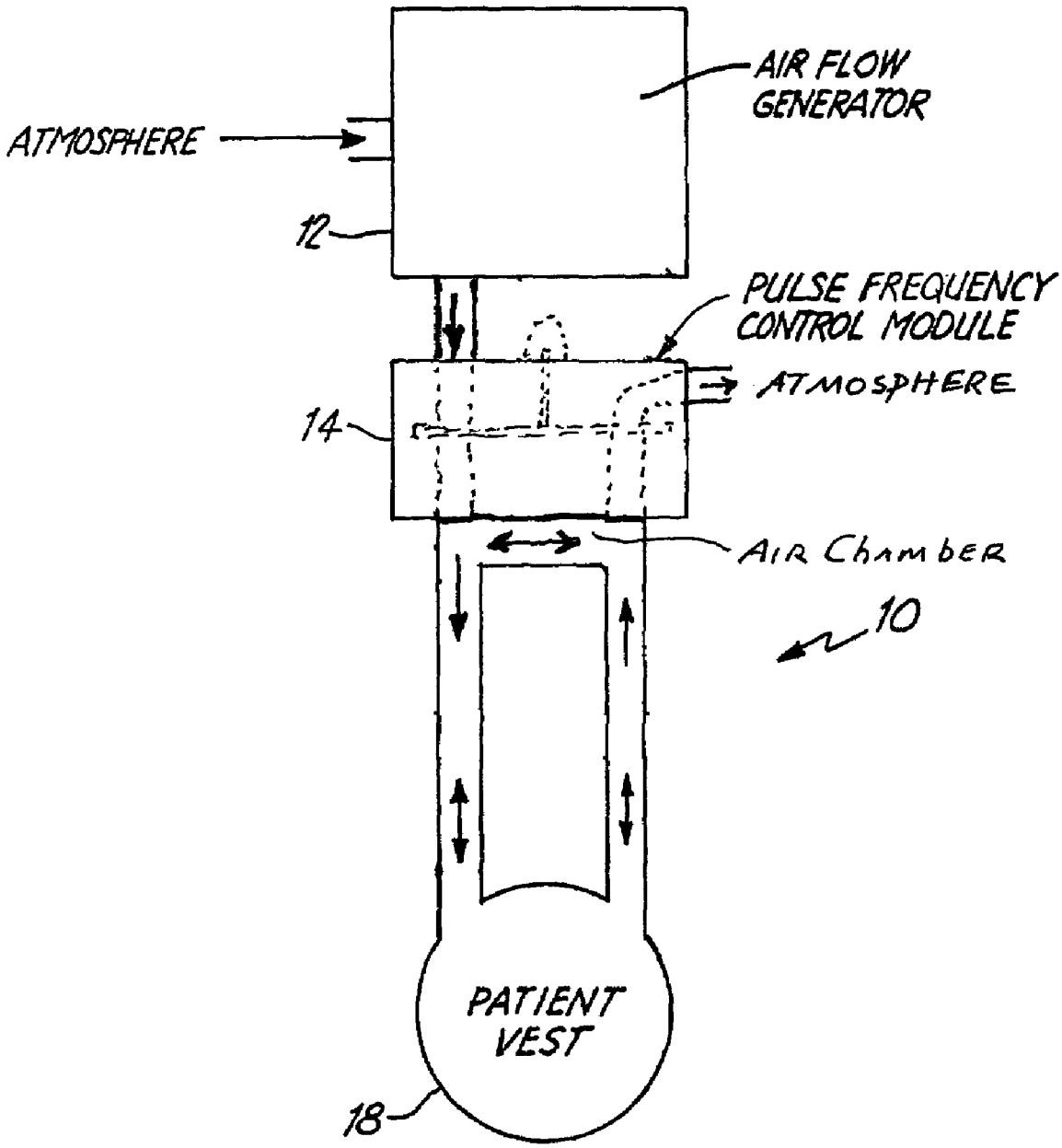

As a further component, the apparatus includes a pressure control unit 16, e.g., having features and functions of the prototype 50 depicted in FIG. 4. The component includes an air inlet port 52 adapted to receive air from the exit port of the pulse frequency control module 14, and effectively provides a manifold or air chamber to controllably deliver air to the vest or atmosphere by means of any suitable combination of vest exit ports 54, 56, and 58, or to the atmosphere by means of optional exit port 59. As depicted in FIGS. 1 and 4, the air chamber of pressure control unit 16 provides fluid communication between the ports 54, 56, 58 and 59, and hence fluid communication between the ports of the pulse frequency control module 14 and the air lines to the patient vest 18. A pulse pressure control 16 can be located between the frequency control module 14 and the vest 18 worn by the patient. In the embodiment of FIG. 5*a*, the manifold of the pressure control unit 16 is shown separated from the pulse frequency control unit 14 and without optional exit port 59. In the embodiment of FIG. 5*b*, the manifold or air chamber is immediately adjacent the pulse frequency control module 14. In a preferred embodiment, a structure defining the air chamber may be connected to the outlet ports of the pulse frequency control module 14. The manifold or air chamber provides fluid communication between the air lines extending to the air vest 18 and the bladder-side ports of the pulse frequency control module 14. Pressure control unit 16 may be active or passive. For example, an active pressure control unit may include electric solenoids, etc. in communication with an electronic controller, microprocessor, etc. A passive pressure control unit 16 may include a manual pressure relief or, in a simple embodiment, pressure control unit 16 may include only the air chamber providing air communication between the air lines extending to the vest 18 and not otherwise including a pressure relief or variable pressure control.

Lightweight flexible tubing connects the vest, pressure control and pulse frequency module. In one embodiment, the pressure control unit 16 consists of a five port manifold or air chamber, in which two are attached to the vest itself, and two are connected to the pulse frequency control module. The fifth is the optional pulse pressure port, which is covered by a floating rubber sphere which is held in place over the port by a spring tether having adjustable tension. Adjusting the tension on the spring provides a means of controlling the amplitude of the pulses while still maintaining a sharp pulse form. The tension can also be controlled electronically to allow bilevel pulse pressure (FIG. 4). In this mode, a breath sensing device can be used to signal the pressure control unit 16 to shift to a lower pulse pressure amplitude on inspiration and return to a higher amplitude during expiration. Yet, the sharp pulse wave form can be maintained regardless of pressure range, with manual override again being an option at any point throughout the cycle.

During patient respiratory inspiration the apparatus pulse pressure can be reduced, for example by opening atmosphere ball 70. This can be accomplished either manually or electronically. During patient exhalation ball valve 70 is in the closed position for maximum peak pulse pressure, or allowed to operate as a maximum pressure relief valve controlled by adjusting spring 76. The manifold receives HFCC pulse pressure waves through port 52 through the frequency control port 26*a*. Port 54 is shown connected to port 26*b* of the frequency control module and is closed to atmosphere when 26*a* is open and open when 26*a* is closed. Ports 56 and 58 are connected to the inflatable vest 18 via flexible tubing, with the vest itself being worn by the patient.

Figure 6:
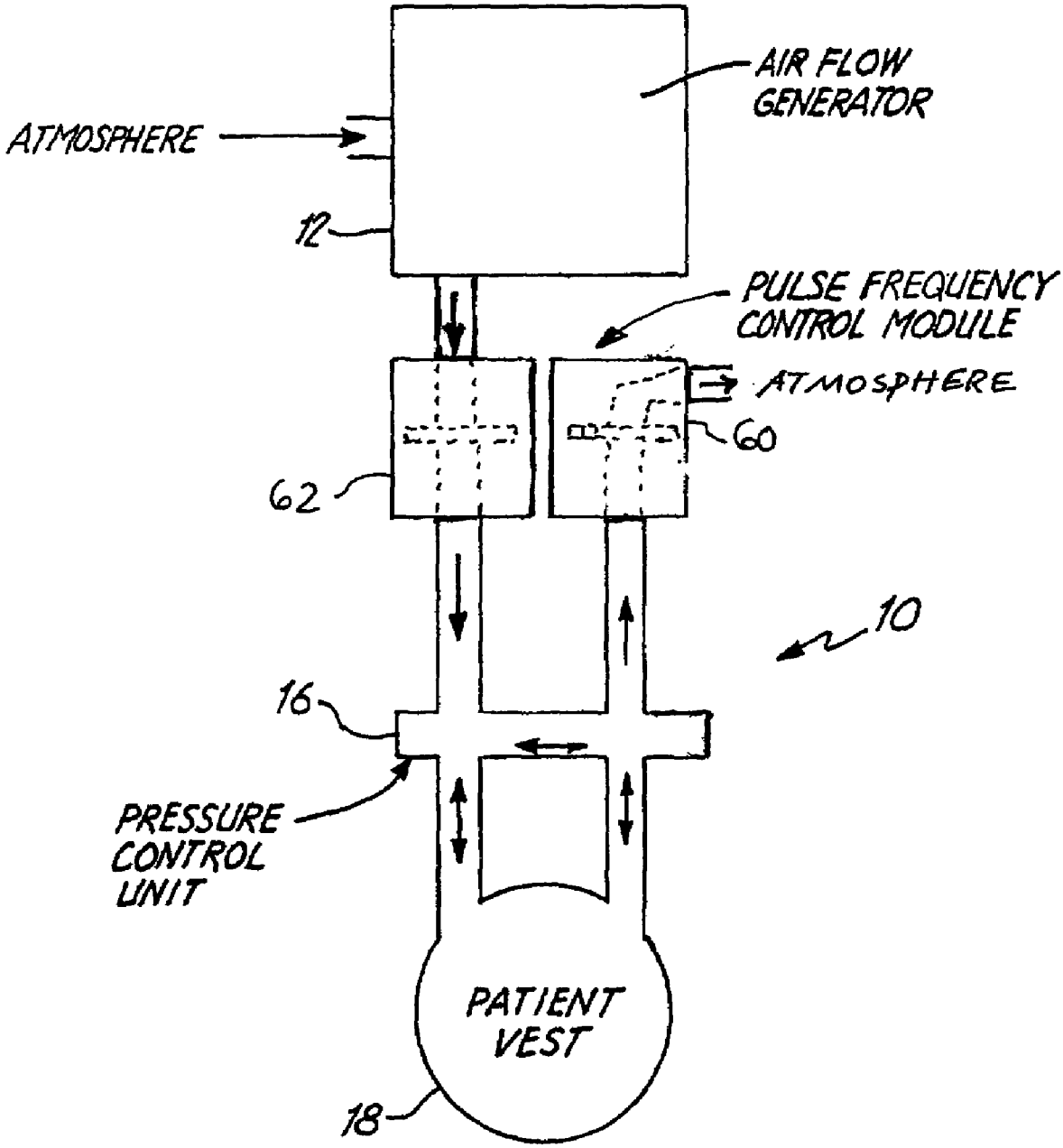
FIG. 6 shows an alternative schematic air flow diagram for an apparatus of the present invention.

In the embodiment of FIG. 6, the pulse frequency control module 14 may comprise a pair of air valves 60, 62. These air valves 60, 62 may be motor-driven rotating valves. Other air valves may also be practicable as appreciated by those of ordinary skill in the art. Air valves 60, 62 may be independently controlled, such as by an electronic controller. For example, air valves 60, 62 may be rotated by an electric motor, such as a stepper motor, under the direction of an electronic motor controller. The air valves 60, 62 may be independently rotated to define a plurality of different waveforms transmitted to the vest. For example a series of triangle waves may be generated for a period of time, followed by a square wave pattern, a sine wave pattern, a series of impulses, etc.

Figure 7:
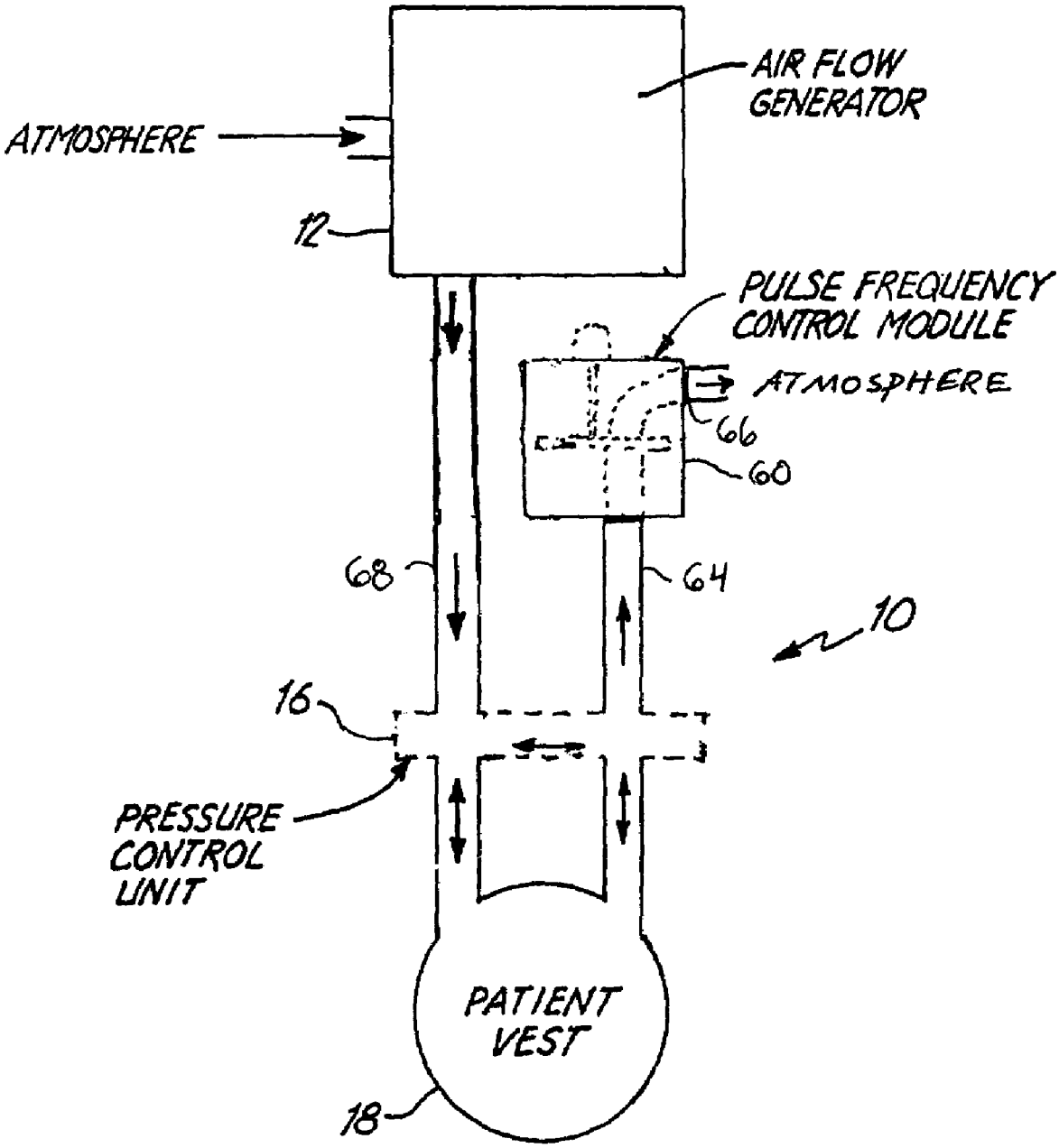
FIG. 7 shows yet another alternative schematic air flow diagram for an apparatus of the present invention.

In the embodiment of FIG. 7, the pulse frequency control module 14 comprises an air valve 60 for controlling the air flow through a jacket air line 64 to a vent port 66. In this embodiment, the jacket line 68 in direct communication with the air flow generator 12 does not include an air valve for controlling the flow of air therethrough. The pressure control unit 16 may be optional in the embodiment of FIG. 7.

HFCC therapy is prescribed as either an adjunct or outright replacement for manual chest physiotherapy. Total therapy time per day varies between about 30 minutes and about 240 minutes spread over one to four treatments per day. Patients can be instructed in either the continuous intermittent mode of HFCC therapy, which may include continuous use of aerosol.

During HFCC therapy the patient sits erect, although leaning against a chair back is acceptable as long as air flow in the vest is not restricted. In the continuous mode, the patient operates the vest for 5 minutes at each of six prescribed frequencies (determined by "tuning" performed during a clinic visit). The patient uses the hand control to stop pulsing as frequently as necessary to cough, usually every several minutes.

In the intermittent mode, the patient uses the hand control to stop pulsing during inspiration to make it easier to inhale maximally. The pulsing is activated again during each expiration. Longer pauses for coughing are taken as needed. The patient goes through the cycle of prescribed frequencies determined by tuning during a clinic visit.

An apparatus of the present invention can be used in the following manner. A vinyl coated polyester inflatable vest is made for each patient, to cover the entire torso from the shoulders to the iliac crest and to fit snugly when the patient inspires to total lung capacity. The optimal design, function and performance of such a vest can be determined by those skilled in the art, based on the present description.

The vest may be "tuned" for each individual to determine the volume of air expressed from the lung and the rate of flow of this air for each chest compression frequency (e.g., from about 5 Hz to about 22 Hz). The flow rates and volume are calculated with a computer program from flow data obtained during tidal breathing through a Hans Rudolph pulmonary pneumotachometer with pinched nose. The frequencies associated with the highest flow rates are usually greater than 13 Hz, while those associated with largest volume are usually less than about 10 Hz. These best frequencies vary from patient to patient. Since the highest induced flow rates usually do not correspond with largest induced volumes, and since 2 to 3 were commonly very close in value, the three highest flow rates and the three largest volumes are selected for each patient's therapy. Occasionally one frequency is selected twice because it produces one of the three highest flow rates and one of the three largest volumes. Each of these six frequencies is prescribed for five minutes for a total of 30 minutes each therapy session. Since the best frequencies change over time with the use of the vest, re-tuning should be performed every 3 to 6 months.

One explanation of the way in which HFCC moves mucus is derived from observations of the perturbations of air flow during tidal breathing and during maximum inspiration and exhalation to residual volume. Each chest compression produces a transient flow pulse very similar to the flow observed with spontaneous coughing. Tuning identifies those transient flows with the greatest flows and volumes, in effect the strongest coughs, and analogously with the greatest power to move mucus in the airways.

The invention claimed is:

1. A chest compression apparatus comprising:

an air bladder adapted to engage at least a portion of the thoracic region of a patient;

an air valve assembly having an air port in fluid communication with a pressurized air source, a vent port in fluid communication with an air vent, and a pair of bladder-side ports, said air valve assembly providing selective fluid communication between the air vent and one of the pair of bladder-side ports and between the vent port and the other bladder-side port; and an air manifold coupled to the air valve assembly, with said air valve assembly periodically interrupting a flow of pressurized air from said source into said air manifold, and said air manifold providing fluid communication between the pair of bladder-side ports and a pair of air lines coupled to the air bladder and with said pair of air lines communicating a series of air pulses to said air bladder, said series of air pulses being established by the flow of pressurized air through the air valve assembly and the air manifold.

2. The chest compression apparatus of claim 1 wherein the air valve assembly comprises a rotating valve which periodically interrupts air flow between the air port and said one of the pair of bladder-side ports and said vent port and said other bladder-side port to provide a periodic pressure waveform to the air bladder.

3. The chest compression apparatus of claim 2 wherein the waveform includes one or more minor perturbations or fluctuations within the pressure waveform.

4. The chest compression apparatus of claim 2 wherein the rotating valve includes a motor-driven blade.

5. The chest compression apparatus of claim 4 wherein the blade is rotated in order to provide pulses having a substantially sinusoidal wave form.

6. The chest compression apparatus of claim 5 wherein the substantially sinusoidal wave form has a frequency selected between the range of 6 to 15 Hz.

7. The chest compression apparatus of claim 4 wherein the motor-driven blade is electronically controlled to allow for an automatic timed cycling of frequencies.

8. The chest compression apparatus of claim 1 wherein the air valve assembly comprises a pair of valves which periodically interrupt air flow between the air port and one of the pair of bladder-side ports and the vent port and the other bladder-side port to provide a non-uniform pressure waveform to the air bladder.

9. The chest compression apparatus of claim 8 wherein the pair of valves is a pair of rotating air valves.

10. The chest compression apparatus of claim 9 wherein each of the pair of rotating air valves is independently controllable.

11. The chest compression apparatus of claim 10 wherein the rotational speed of one of the pair of valves may be different than the rotational speed of the other valve.

12. The chest compression apparatus of claim 1 wherein the air manifold is defined within a pressure control unit.

13. The chest compression apparatus of claim 12 wherein the pressure control unit is adapted to permit a user to control the pressure delivered to the air bladder.

14. The chest compression apparatus of claim 1 wherein the pressurized air source includes a variable speed air fan.

15. The chest compression apparatus of claim 14 wherein the variable speed fan is controlled by an electronic controller so that a fan speed varies during a therapy period.

16. The chest compression apparatus of claim 15 wherein the fan speed is decreased during a period of inhalation as compared to a fan speed during a period of exhalation.

17. A chest compression apparatus comprising:

an air bladder adapted engage at least a portion of the thoracic region of a patient;

an air line coupled between the air bladder and a source of pressurized air;

a vent line coupled to the air bladder; and an air manifold coupled to the air line and the vent line and an air valve assembly, with said air valve assembly periodically interrupting a flow of pressurized air from said source and into said air manifold, and with said air valve assembly providing intermittent fluid communication between the vent line and a vent port to atmosphere resulting in a series of pressure pulses applied to the thoracic region by the air bladder.

18. The chest compression apparatus of claim 17 wherein the air valve assembly comprises a rotating valve which periodically interrupts air flow between the vent port and a second air line.

19. The chest compression apparatus of claim 18 wherein the rotating valve includes a motor-driven blade.

20. The chest compression apparatus of claim 19 wherein the blade is rotated in order to provide pulses having a substantially sinusoidal wave form.

21. The chest compression apparatus of claim 20 wherein the substantially sinusoidal wave form has a frequency selected between the range of 6 to 15 Hz.

22. The chest compression apparatus of claim 21 wherein the motor-driven blade is electronically controlled to allow for an automatic timed cycling of frequencies.

23. The chest compression apparatus of claim 17 wherein the waveform includes one or more minor perturbations or fluctuations within the pressure waveform.

24. The chest compression apparatus of claim 17 wherein the air valve assembly comprises a pair of valves which periodically interrupt air flow between a pressurized air port and the air bladder and the vent port and a second air line to provide a non-uniform pressure waveform to the air bladder.

25. The chest compression apparatus of claim 24 wherein the pair of valves is a pair of rotating air valves.

26. The chest compression apparatus of claim 25 wherein each of the pair of rotating air valves is independently controllable.

27. The chest compression apparatus of claim 26 wherein the rotational speed of one of the pair of valves may be different than the rotational speed of the other valve.

28. The chest compression apparatus of claim 26 wherein the air manifold is defined within a pressure control unit.

29. The chest compression apparatus of claim 28 wherein the pressure control unit is adapted to permit a user to control the pressure delivered to the air bladder.

30. The chest compression apparatus of claim 17 wherein the pressurized air source includes a variable speed air fan.

31. The chest compression apparatus of claim 30 wherein the variable speed fan is controlled by an electronic controller so that a speed of the fan varies during a therapy period.

32. The chest compression apparatus of claim 31 wherein the fan speed is decreased during a period of inhalation as compared to a fan speed during a period of exhalation.

33. A method of applying pressure pulses to the thoracic region of a patient comprising the steps of:

providing an air bladder adapted to engage the thoracic region of the patient, said air bladder being connected to a pair of air lines in fluid communication with an air manifold;

providing an air valve assembly having a pressurized air port, a vent port and a pair of bladder-side ports, said pressurized air port being coupled to a source of pressurized air and said pair of bladder-side ports;

providing the pair of bladder side ports and the pair of air lines in fluid communication via the air manifold operating a movable element within the air valve assembly to periodically interrupt air flow from the course of pressurized air into the air manifold and the air port and the vent port so as to apply a series of air pulses to the thoracic region; and bypassing some air from one of the pair of air lines into the other of the pair of airlines via said air manifold.

34. The method of claim 33 wherein the movable element is a motor-driven valve.

35. The method of claim 34 wherein rotation of the valve is electronically controlled so that a frequency of the air pulses can be adjusted by a user.

36. The method of claim 33 further comprising the step of:

applying one or more minor perturbations or fluctuations to the series of air pulses.

37. The method of claim 33 further comprising the step of:

decreasing an amplitude of the air pulses during periods of respiratory inspiration of the user.

38. The method of claim 33 further comprising the step of:

increasing an amplitude of the air pulses during periods of respiratory exhalation of the user.

39. A method of applying pressure pulses to the thoracic region of a patient comprising the steps of:

connecting the an air bladder to a pressurized air line, with said air bladder being positioned at the thoracic region of the patient;

connecting the air bladder to a vent line;

connecting the pressurized air line and the vent line to an air manifold;

connecting the air manifold to an air valve assembly, said air valve assembly including a rotating disk valve element which periodically interrupts air flow within the air line or the vent line or both to apply a series of pulses from a source of pressurized air into the air manifold and the air bladder and thoracic region; and bypassing some air from the pressurized air line into said vent line via said air manifold while the series of pulses are conveyed to the air bladder.

40. The method of claim 39 wherein rotation of the disk valve element is electronically controlled so that a frequency of the air pulses can be adjusted by a user.

41. The method of claim 39 further comprising the step of:

applying one or more minor perturbations or fluctuations to the series of air pulses.

42. The method of claim 39 further comprising the step of:

decreasing an amplitude of the air pulses during periods of respiratory inspiration of the user.

43. The method of claim 39 further comprising the step of:

increasing an amplitude of the air pulses during periods of respiratory exhalation of the user.

* * * * *

UNITED STATES PATENT AND TRADEMARK OFFICE

CERTIFICATE OF CORRECTION

PATENT NO. : 7,597,670 B2
APPLICATION NO. : 11/204547
DATED : October 6, 2009
INVENTOR(S) : Warwick et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1087 days.

Signed and Sealed this

Twenty-eighth Day of September, 2010

David J. Kappos

David J. Kappos
*Director of the United States Patent and Trademark Office*